US006108947A

United States Patent [19]

Brand et al.

[11] Patent Number: 6,108,947

[45] Date of Patent: Aug. 29, 2000

[54] BUCKET DREDGER

[75] Inventors: Jacob Brand, 's-Gravendeel; Cornelis Van Der Zouwen, Werkendam, both of Netherlands

[73] Assignee: IHC Holland N. V., Ep Sliedrecht, Netherlands

[21] Appl. No.: 08/248,003

[22] Filed: May 24, 1994

[30] Foreign Application Priority Data

May 26, 1993 [NL] Netherlands ..... 9300894

[51] Int. Cl.[7] ..... E02F 3/14

[52] U.S. Cl. ..... 37/338; 37/339; 37/462; 37/465; 198/307.1; 198/710

[58] Field of Search ..... 37/338, 339, 352, 37/353, 354, 355, 359, 360, 388, 462, 463, 465; 198/307.1, 509, 710

[56] References Cited

U.S. PATENT DOCUMENTS

| | | | |
|---|---|---|---|
| 246,362 | 8/1881 | Angell | 37/338 |
| 366,010 | 7/1887 | Knott | 37/338 |
| 541,193 | 6/1895 | Warren | 37/338 |
| 640,762 | 1/1900 | Gray | 37/338 |
| 710,054 | 9/1902 | Hammond | 198/710 X |
| 1,043,113 | 11/1912 | Krupp | 37/353 |
| 1,880,807 | 10/1932 | Clark et al. | 37/354 |
| 2,132,198 | 10/1938 | Whisler | 198/710 |
| 2,477,221 | 7/1949 | Von Bolhar | 308/26 |
| 2,528,195 | 10/1950 | Von Bolhar | 37/338 |
| 2,763,945 | 9/1956 | MacKenzie | 37/339 |

FOREIGN PATENT DOCUMENTS

| | | | |
|---|---|---|---|
| 2 012 334 | 3/1970 | France . | |
| 899028 | 7/1949 | Germany . | |
| 2909272 | 4/1980 | Germany . | |
| 243057 | 2/1987 | Germany | 37/465 |
| 7609080 | 2/1978 | Netherlands . | |
| 3554 | 10/1875 | United Kingdom | 37/338 |
| 371 191 | 4/1932 | United Kingdom . | |
| 405088 | of 1934 | United Kingdom | 37/353 |

OTHER PUBLICATIONS

The Encyclopedia Americana ©1978, vol. 22, p. 366, entry entitled "POLYGON".

*Primary Examiner*—Brian K. Green
*Assistant Examiner*—Andrea Chop
*Attorney, Agent, or Firm*—Foley & Lardner

[57] ABSTRACT

Bucket dredger, comprising: a swivelling ladder connected to a vessel, a driven upper wheel at the top end and a polygonal lower wheel (7) at the lower end of the ladder, one or more endless chains (6) which are guided along both wheels, and buckets (9) connected to the shackles (8) of these chains (6). For receiving the lateral force exerted on a bucket the bottom wall (12) of each bucket (9) is provided with two ribs (15) extending downwardly, which extend substantially parallel to the side walls (14) of the bucket and which, in the assembled state of the bucket, extend adjacent the chains (6) and between the chains and upright edges (16) placed on the lower wheel (7). The ribs (15) can extend along the length of two shackles (8).

5 Claims, 2 Drawing Sheets

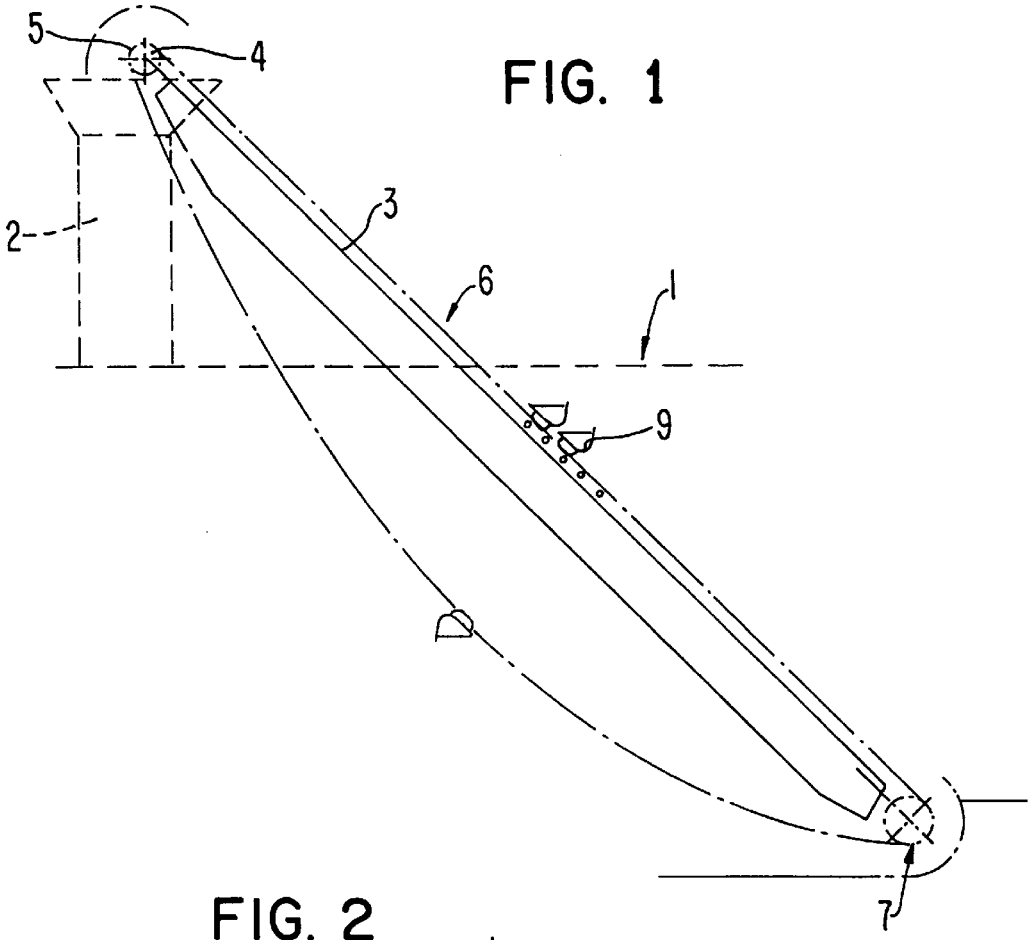
FIG. 1
FIG. 2
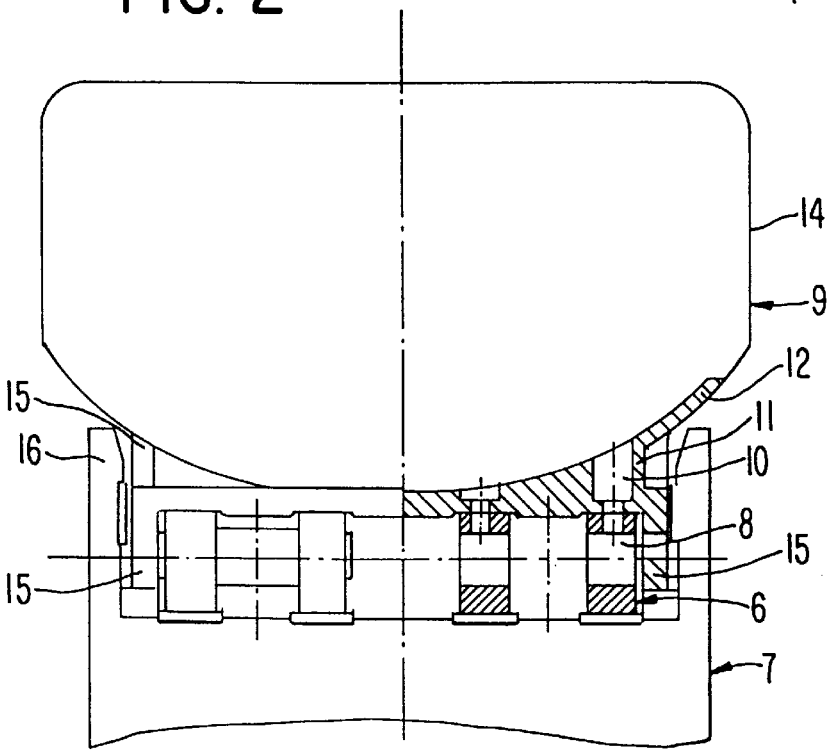

FIG. 3
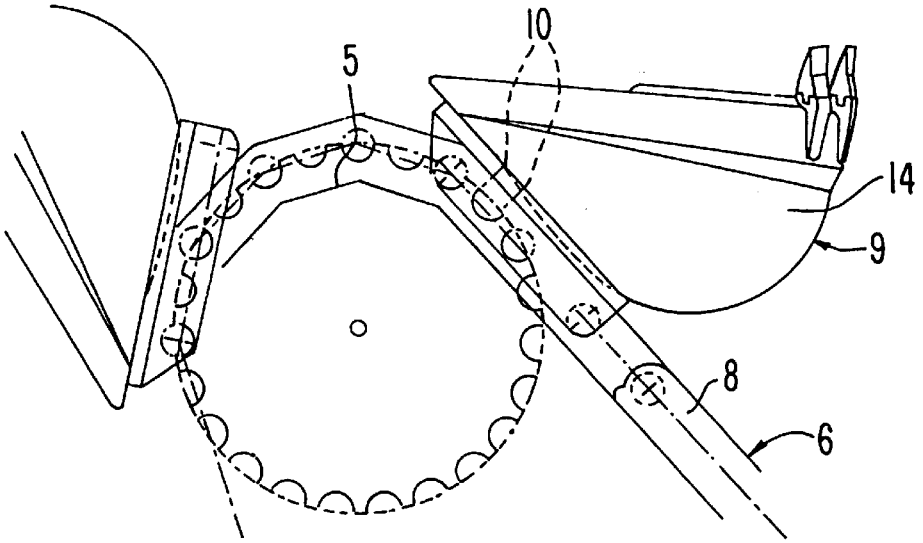
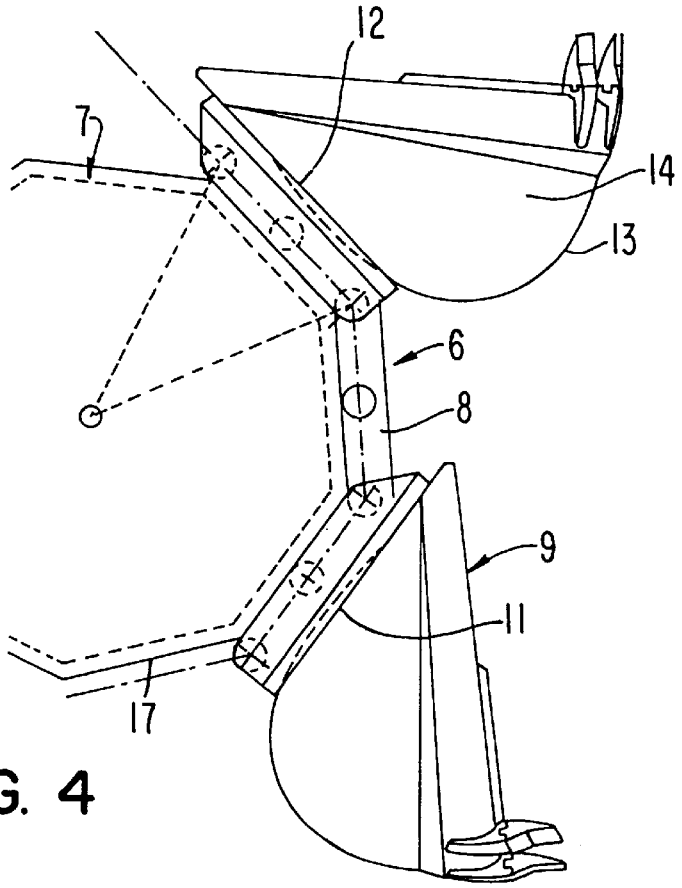
FIG. 4

BUCKET DREDGER

BACKGROUND OF THE INVENTION

The invention relates to a bucket dredger, and more specifically to a bucket dredger with a swivelling ladder connected to a vessel, a driven upper wheel at the top end and a regular or irregular polygonal lower wheel at the lower end of the ladder, one or more endless chains which are guided along both wheels, and buckets connected to the shackles of these chains.

Such bucket dredgers are known in the art. While in the bucket dredgers of old, the buckets are connected to each other either directly hingingly or through an intermediate shackle, the use of endless chains, to which the buckets are fixed to the shackles thereof, has the advantage that assembly of the whole is simpler and that a bucket can be replaced easily.

Although, naturally, the chains on the wheels are also guided in a lateral direction, this guiding is generally not sufficient for bearing the loads exerted laterally on the buckets without any problems. Because the chains will never be able to be stretched completely taut, a chain will be able to be lifted off the lower wheel when a lateral force is exerted on the bucket, and it then shall not experience sufficient support from its lateral guide. This holds true especially when large volume buckets are to be used.

The bucket dredgers embodied in this fashion are therefore in principle used as elevator dredgers, i.e. the dredging machine is displaced only in the direction of the ladder and not sideways.

SUMMARY OF THE INVENTION

The invention has the objective of conventional dredging machines more universally applicable. To that end it provides that the bottom wall of each bucket is provided with two ribs extending downwardly, which extend substantially parallel to the side walls of the bucket and which, in the assembled state of the bucket, extend adjacent to the chains and can cooperate with upright edges placed on the lower wheel In this way it is achieved that with lateral swivelling of the bucket dredger, conventionally as with bucket dredgers, the lateral force exerted on a bucket is passed directly to the lower wheel through the rib connected to the bucket.

Although it is possible in principle to place the ribs on a bucket such that they will be located on the outside of the upright edges of the lower wheel, it is preferable to provide that each rib is located between a chain and an upright edge of the lower wheel, the upright edges being located on the outside of each of the ribs.

Then the ribs can be more or less directly connected to the supports, placed on the bucket, which serve to connect the bucket to the chains.

With the buckets that are normally used, the distance-measured in the longitudinal direction of the chain between the supports, which serve for fixing the bucket to a chain shackle, is determined by the length of the shackles. However, when larger buckets are to be used, as mentioned above, there is the objection that the shackles of chains normally commercially available are of relatively small length with respect to the dimension of the bucket in the direction concerned. Manufacturing chains with longer shackles does not make sense economically, for also the driven upper wheel will require a larger size.

While utilizing the above-mentioned construction, there is the possibility of adapting the distance between the supports to the length of the shackle of the largest chain normally commercially available, while the ribs placed on the bucket extend outwardly from the supports and along substantially the whole length of the bottom wall of the bucket, so that they can extend along a shackle following the shackle which is connected to the bucket, the lower wheel being embodied such that at least two shackles of the chain come to lie in line with each other.

In this fashion it is effected that the ribs connected to the bucket are supported by the upright edges of the lower wheel throughout the whole lent thereof at a position where a lateral force can be exerted on the bucket. However, the dimensions of the driven upper wheel need only to be adapted to the length of one shackle, since lateral forces will hardly be exerted on the bucket at that position.

BRIEF DESCRIPTION OF THE DRAWINGS

The invention is illustrated by means of an embodiment, which is depicted in the drawing, in which:

FIG. 1 is a schematic depiction of a side elevation of a dredging vessel with the ladder placed on it, provided with two chains with a few buckets connected to it, FIG. 2 is a schematic view of part of the cross-section of the lower wheel of the ladder with the chains and a bucket connected to it; and FIGS. 3 and 4 are schematic side elevations of the upper wheel, and the lower wheel, respectively, with two buckets located therewith.

DETAILED DESCRIPTION OF THE PREFERRED EMBODIMENT

FIG. 1 depicts the dredging vessel—of which only a few parts have been indicated with dashed lines—indicated by the numeral 1. It comprises a support construction 2 for rotatingly supporting the ladder 3 in the point of rotation 4.

The center line of the point of rotation 4 coincides with the center line of a driven upper wheel 5 on which two chains 6 move, which move along the lower wheel 7 at the bottom end of the ladder. The lower wheel 7 may be a regular or irregular polygon. As seen in particular in FIGS. 3 and 4, buckets 9 are connected to certain shackles 8 of the chains 6.

Each bucket 9 is connected to a shackle 8 through bolts 10, of which only the center line is indicated and which pass through supports 11, which are part of the bottom wall 12 of the bucket 9. As seen in FIGS. 3 and 4, the bottom wall 12 propagates in a bent front wall 13 and the bucket is enclosed sideways by the side walls 14. The bottom wall 12, the front wall 13 and the side walls 14 of the bucket 9 can have different forms and they do not necessarily have to be flat.

The bottom wall 12 of the bucket 9 is provided with two ribs 15, with each being located between a chain 6 and an upright edge 16 of the lower wheel 7, as seen in particular in FIG. 2. It is apparent that when a lateral force is exerted on a bucket 9, that this will be received by one of the upright edges 16 of the lower wheel 7.

As seen in particular in FIG. 3, the bucket 9 is connected to one shackle 8 of each one of the chains 6 by means of bolts 10, and the ribs 15 extend in the longitudinal direction along two shackles 8, as also appears from FIG. 4. The sides 17 of the polygonal lower wheel 7 shall therefore have a length such that always two shackles 8 will be supported by one side. The ribs 15 also can be supported by the upright edges 16 along the whole length thereof as long as the ribs are located at the lower wheel 7. It is apparent that when swivelling the dredging vessel around its vertical axis, tha largest lateral force will be exerted on the buckets in this position.

It is apparent that only one possible embodiment of a device according to the invention has been illustrated in the drawings and described in the foregoing, and that numerous modifications can be brought about without departing from the spirit of the invention.

The invention claimed is:

1. A bucket dredger, comprising:

a swivelling ladder for connecting to a vessel;

a driven upper wheel at a top end of the ladder and a polygonal lower wheel at a lower end of the ladder, the lower wheel having upright edges;

at least one endless chain guided on the wheels; and buckets bound to a plurality of shackles of the at least one chain; each of the buckets including a bottom wall provided with two ribs extending downwardly, the ribs extending substantially parallel to the side walls of the bucket and substantially alone a length of the bottom wall, the ribs, in an assembled state of the bucket, extending adjacent to the at least one chain, and the upright edges on the lower wheel engaging and supporting the ribs.

2. The bucket dredger as claimed in claim 1, wherein each rib is located between the at least one chain and one of the upright edges of the lower wheel, the upright edges being located on an outside of each of the ribs.

3. The bucket dredger as claimed in claim 2, further comprising supports placed on the bucket for connecting the bucket to the at least one chain, a distance between the supports being adapted to a length of the shackle of the chain; the ribs on the bucket extending outwardly from the supports and along substantially the whole length of the bottom wall of the bucket, such that the ribs extend along one of the shackles following the shackle which is connected to the bucket, the lower wheel provided with at least two shackles of the chain lying in line.

4. The bucket dredger as claimed in claim 1, further comprising supports placed on the bucket for connecting the bucket to the at least one chain, a distance between the supports being adapted to a length of the shackle of the chain; the ribs on the bucket extending outwardly from the supports and along substantially the whole length of the bottom wall of the bucket, such that the ribs extend along one of the shackles following the shackle which is connected to the bucket, the lower wheel provided with at least two shackles of the chain lying in line.

5. The bucket dredger as claimed in claim 1, wherein the polygonal lower wheel is regular.

* * * * *